US008191890B2

(12) United States Patent
Franzone et al.

(10) Patent No.: US 8,191,890 B2
(45) Date of Patent: Jun. 5, 2012

(54) SINGULATOR DEVICE FOR STANDARD AND EXTENDED POSTAL OBJECTS

(75) Inventors: Cristiano Franzone, Genoa (IT); Matteo Bazzano, Genoa (IT); Stefano De Poli, Genoa (IT)

(73) Assignee: Selex Elsag S.p.A., Genoa (IT)

( * ) Notice: Subject to any disclaimer, the term of this patent is extended or adjusted under 35 U.S.C. 154(b) by 0 days.

(21) Appl. No.: 13/051,969

(22) Filed: Mar. 18, 2011

(65) Prior Publication Data

US 2011/0278785 A1 Nov. 17, 2011

(30) Foreign Application Priority Data

Mar. 19, 2010 (EP) ..... 10425082

(51) Int. Cl.
*B65H 1/02* (2006.01)

(52) U.S. Cl. ..... 271/149; 271/150

(58) Field of Classification Search ..... 271/149, 271/150

See application file for complete search history.

(56) References Cited

U.S. PATENT DOCUMENTS

| | | | | |
|---|---|---|---|---|
| 4,171,130 | A | 10/1979 | Jeschke et al. | |
| 4,634,328 | A | 1/1987 | Carrell | |
| 5,044,877 | A * | 9/1991 | Constant et al. | 414/798.9 |
| 5,657,982 | A * | 8/1997 | Holmes et al. | 271/149 |
| 5,713,713 | A | 2/1998 | Syde et al. | |
| 5,829,742 | A * | 11/1998 | Rabindran et al. | 271/150 |
| 6,354,587 | B1 * | 3/2002 | Engarto | 271/149 |
| 6,679,491 | B2 * | 1/2004 | Luebben et al. | 271/150 |
| 6,749,193 | B2 * | 6/2004 | Berdelle-Hilge et al. | 271/149 |
| 7,182,331 | B2 * | 2/2007 | Berdelle-Hilge et al. | 271/150 |
| 2002/0053768 | A1 * | 5/2002 | Blackwell et al. | 271/31.1 |
| 2002/0153654 | A1 * | 10/2002 | Blackwell et al. | 271/96 |
| 2009/0242464 | A1 | 10/2009 | Stubleski et al. | |

FOREIGN PATENT DOCUMENTS

| | | |
|---|---|---|
| DE | 10140497 | 3/2003 |
| EP | 0696482 | 2/1996 |
| JP | 61139934 | 8/1986 |
| WO | WO 9115416 | 10/1991 |

OTHER PUBLICATIONS

European Search Report from European Patent Application No. EP10425082 dated Aug. 10, 2010.

* cited by examiner

*Primary Examiner* — David H Bollinger
(74) *Attorney, Agent, or Firm* — Workman Nydegger

(57) ABSTRACT

A singulator device for standard postal objects and extended postal objects, configured for receiving at input groups of standard/extended plane rectangular postal objects grouped in packs and supplying at output singulated standard/extended postal objects, i.e., each one is physically separated from the others. The device comprises: a singulator system; a resting surface for the packs of postal objects; and a drawing system that displaces the packs towards the singulator system, designed to withdraw individually the postal objects that form a front end face of the pack. Also provided is a supporting device, configured for providing abut surfaces on opposite end portions of the packs formed by extended postal objects to keep the extended postal objects with planes of lie substantially perpendicular to the direction of advance, thus preventing the extended postal objects from possibly bending towards the adjacent packs formed by standard postal objects.

10 Claims, 6 Drawing Sheets

SINGULATOR DEVICE FOR STANDARD AND EXTENDED POSTAL OBJECTS

CROSS-REFERENCE TO RELATED APPLICATIONS

This application claims priority to European Patent Application No. 10425082.4 filed Mar. 19, 2010, the disclosure of which is incorporated herein by this reference.

TECHNICAL FIELD

Embodiments of the present invention relate to a singulator device for standard and extended postal objects.

BACKGROUND

As is known, a singulator device receives at input groups of plane rectangular postal objects grouped in packs and feeds at output singulated postal objects, i.e., ones physically separated from each other.

For example, U.S. Pat. No. 4,634,328 (Mail Singulation System), WO91/15416 (Flat mail Singulation Apparatus), U.S. Pat. No. 4,171,130 (Control of withdrawal of flat items individually from a stack), and DE 101 40 497 illustrate singulator devices for postal objects.

Typically, the packs of approximately parallelepipedal postal objects slide along a horizontal plane of rest under the thrust of a drawing system that displaces the packs towards a singulator system designed to withdraw individually the postal objects that form a front end face of the pack. Typically, the packs move in a rectilinear direction of advance. The singulator system, for example, can comprise a motor-driven belt, which provides a vertical plane gripping portion associated to an intake device; the postal objects that form the front face of the pack come to bear upon the plane gripping portion that moves the objects in a direction perpendicular to that of advance, separating them from the pack.

In some processing modes, packs comprising postal objects having considerably different formats are fed to the singulator device, in particular packs comprising postal objects having standard dimensions, i.e., postal objects having maximum dimensions of up to 292 mm (length)×176 mm (height) alternating with packs comprising postal objects having extended dimensions, i.e., postal objects having maximum dimensions exceeding the standard format and up to the known C4 format (length 324 mm×height 229 mm) including types such as open magazines and poly-wrapped objects.

In said processing mode, it has been found by the applicant how the packs comprising postal objects with extended formats characterized by modest stiffness tend to "open up", i.e., the postal objects set at the end of the pack bend towards the packs of standard postal objects adjacent thereto. In this way, said bent extended postal objects can assume positions not consonant with the extraction by the singulator system.

SUMMARY

One or more embodiments of the present invention provide a singulator device that will solve the drawbacks of the known devices and will enable singulation of packs of standard postal objects and packs of extended postal objects.

The aforesaid aim is achieved by at least some embodiments of the present invention in so far as it relates to a singulator device for standard postal objects and extended postal objects configured for receiving at input groups of standard/extended plane rectangular postal objects grouped in packs and supplying at output singulated standard/extended postal objects, i.e., each one physically separated from the others, the device comprising: a singulator system; a resting surface for the packs of postal objects;

a drawing system that displaces the packs towards said singulator system designed to withdraw individually the postal objects that form a front end face of the pack; the postal objects forming the front face of the pack abut against a gripping portion that moves the objects in a direction transverse to that of advance, separating them from the pack, said device being characterized in that it comprises supporting means configured for providing abutments on opposite top end portions of the packs comprising extended postal objects to keep the extended postal objects with planes of lie substantially perpendicular to the direction of advance, preventing the extended postal objects from possibly bending towards the adjacent packs formed by standard postal objects.

BRIEF DESCRIPTION OF THE DRAWINGS

Embodiments of the invention will now be illustrated with particular reference to the attached figures in which.

DETAILED DESCRIPTION

Figure 1:
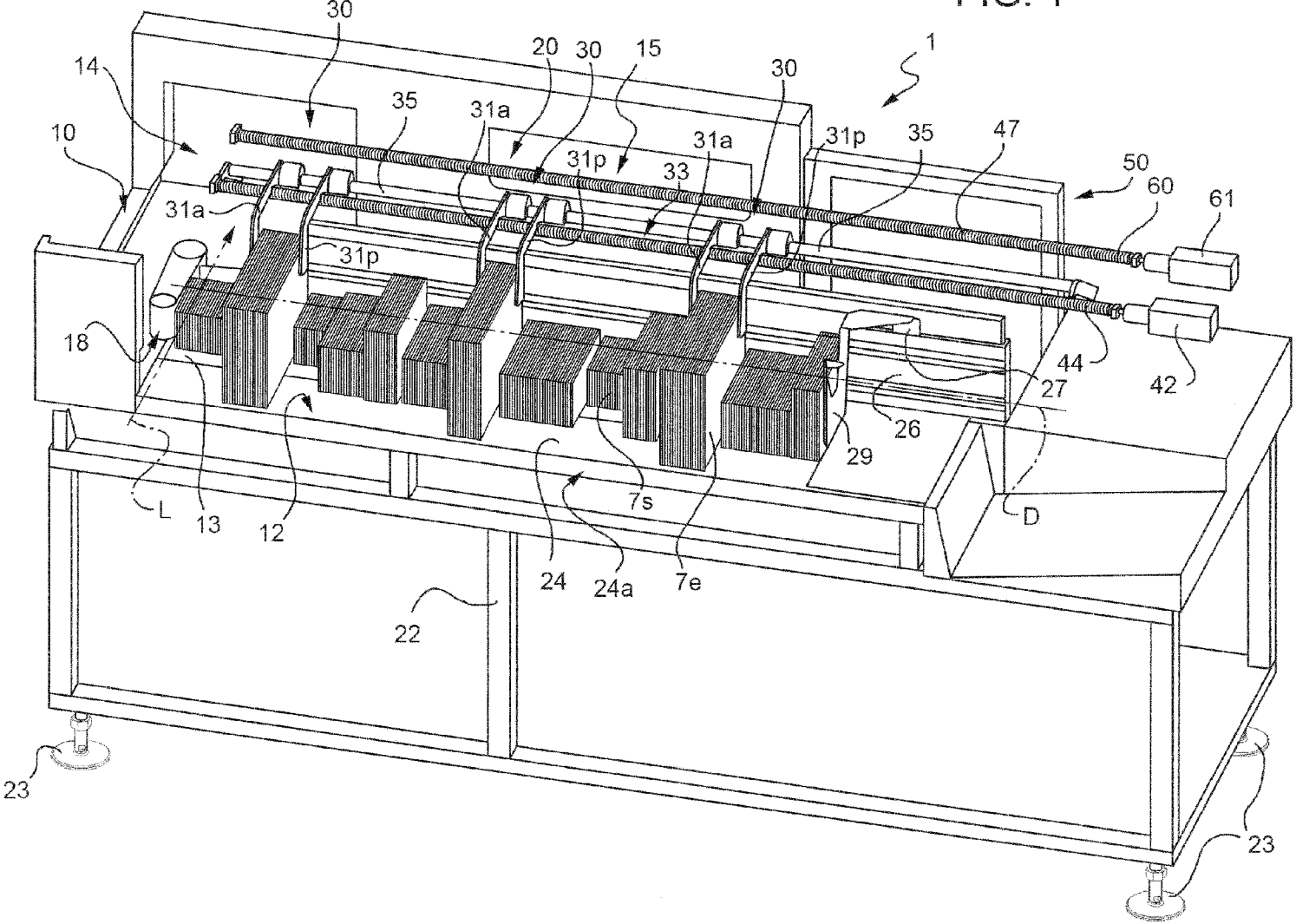
FIG. 1 illustrates, in perspective view, a singulator device for standard postal objects and extended postal objects, which is built according to an embodiment of the present invention.

Designated as a whole by 1 in FIG. 1 is a singulator device for standard postal objects 7*s* and extended postal objects 7*e*.

Figure 6:
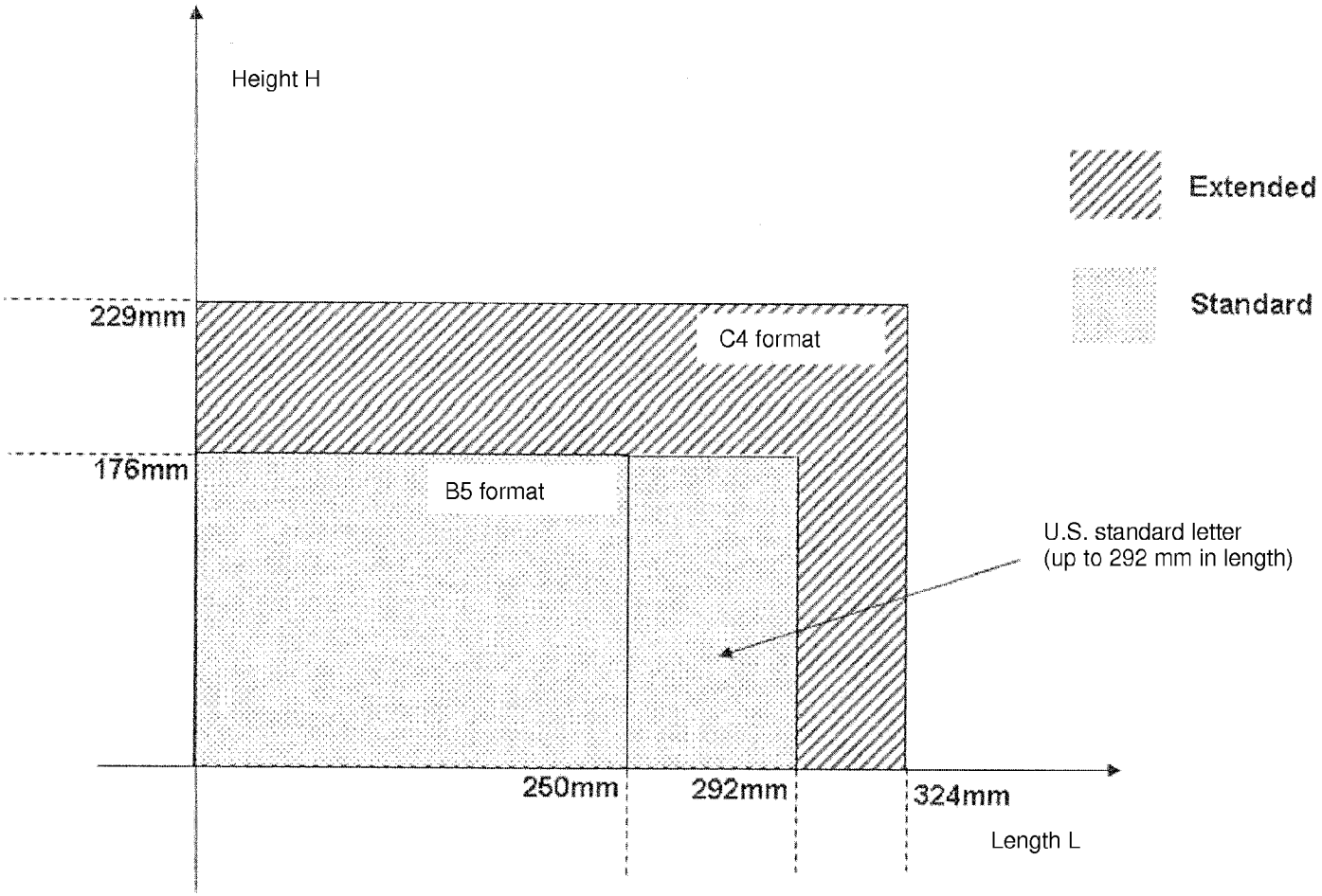
FIG. 6 exemplifies the types of standard/extended postal objects handled by the device according to an embodiment of the present invention.

By "standard postal objects" 7*s* are understood (see FIG. 6) plane rectangular postal objects (letters, postcards, documents in envelopes, etc.) having maximum dimensions of up to 292 mm in length and 176 mm in height.

By "extended postal objects" 7*e* are understood postal objects having formats larger than what is defined herein as standard postal objects and with formats of up to C4 format (length 324 mm, height 229 mm). Also postal objects of dimensions (height and length) slightly larger (by a few millimeters) than the C4 format, if not characterized by high stiffness, can be processed by the device forming the subject of embodiments of the present invention and hence can be considered as extended postal objects.

The singulator device 1 is configured for receiving, at input, groups of plane rectangular postal objects grouped to form packs, and supplying, at output, singulated postal objects 7*s*, 7*e*, i.e., ones physically separated from each other.

The device 1 comprises:

- a singulator system 10 (of a known type and consequently not described in detail);
- a plane rectangular resting surface 12 for the packs of postal objects on which a plane motor-driven belt 13 runs;
- a drawing system 15 (obtained with known techniques), which displaces the packs along the belt 13 parallel to a direction of advance D towards the singulator system 10, which is set at one end of the rectangular resting surface 12.

The singulator system 10 is designed to withdraw individually the postal objects that form a front end face of the pack; in particular, as will be clarified hereinafter, the postal objects forming the front face of the pack come to bear upon a gripping portion 18 (represented only partially), which moves the objects in a direction of unloading L transverse to the direction of advance D, separating them from the pack and feeding them at output, separate from one another.

Provided according to an embodiment of the present invention is a supporting device 20 having parts (described in detail hereinafter) designed to set themselves bearing on opposite top end portions of the packs formed by extended postal objects 7*e* to keep the extended postal objects 7*e* with planes of lie substantially perpendicular to the direction D of advance, preventing the extended postal objects 7*e* from possibly bending towards the adjacent packs formed by standard postal objects 7*s*.

In particular, the parts illustrated above are carried by a parallelepipedal metal bench 22, which is provided with conical resting feet 23 and supports on top a rectangular metal plate 24 defining the resting surface 12.

A first major rectilinear edge 24*a* of the rectangular surface 24 extends flush with one side of the bench 22, whilst a high major rectilinear edge (not illustrated) extends parallel to an elongated area of the bench 22, extending along which is a rectilinear guide 26, which is parallel to the direction D and belongs to the drawing system 15. The drawing system 15 further comprises a slide 27 (represented only partially) that runs along the guide 26 under the thrust of a motor device (not illustrated).

The slide 27 comprises a plane pusher element 29 (messer blade or also paddle) having plane of lie transverse to the direction D and perpendicular to the resting surface 12.

The pusher element 29 is designed to come to bear upon a rear face of a pack resting on the top surface of the belt 13 so as to move a front face of the pack towards the singulation system 10, which is set in the proximity of a minor edge of the rectangular plate 24.

The supporting device 20 comprises a plurality of supporting units 30, each of which is designed to couple with a respective pack of extended postal objects 7*s*.

Figure 3:
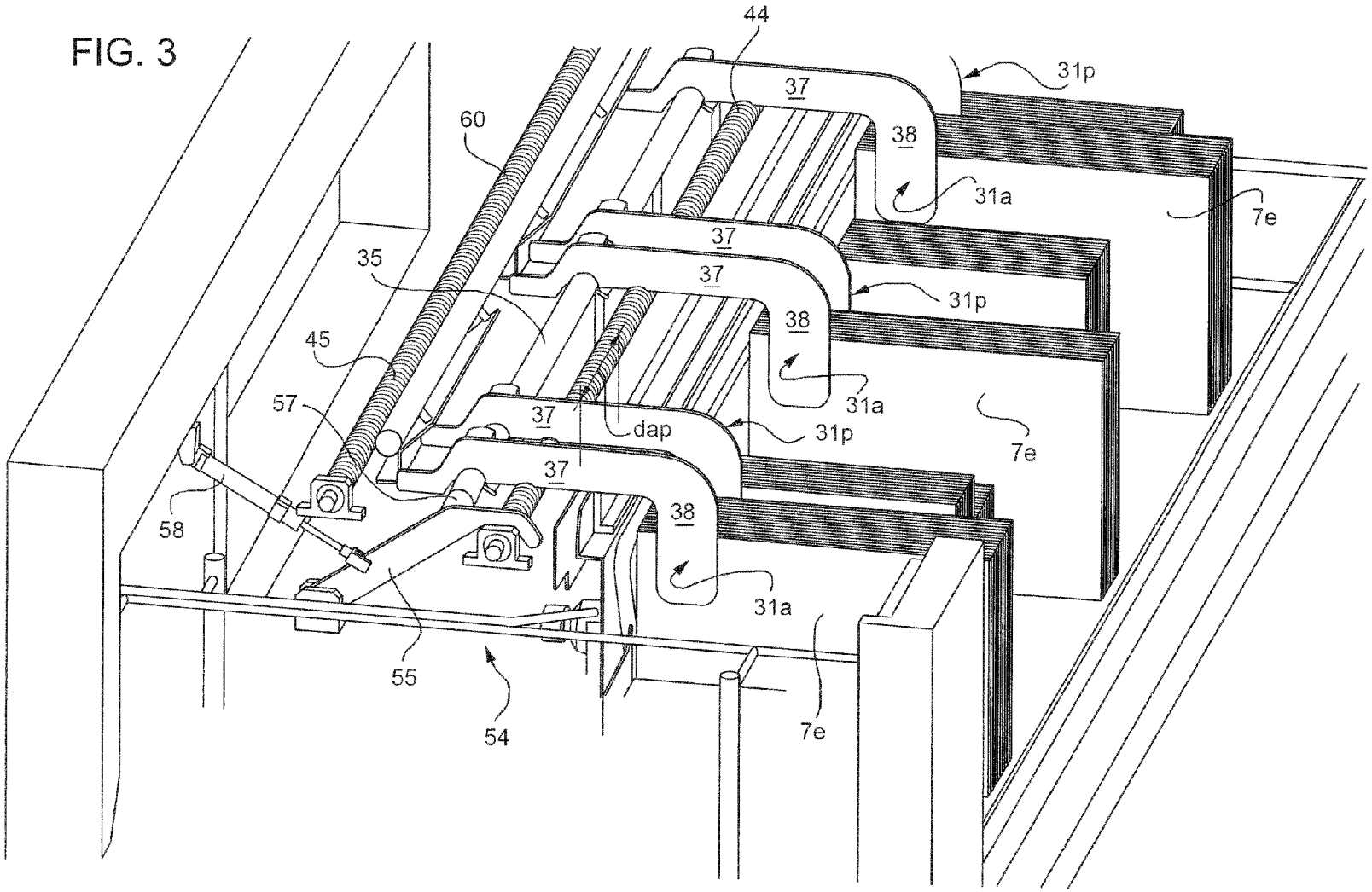
FIG. 3 illustrates, in perspective view, a detail of FIG. 2.

A supporting unit 30 comprises a first (front) abut element 31*a* and a second (rear) abut element 31*p*, the distance between which, $d_{a,p}$ in the direction D (FIG. 3) can be adjusted in order to set the abut elements 31*a*, 31*p* in contact with a top portion of a front face and, respectively, a rear face of the pack of extended postal objects 7*e*; both of the abut elements 31*a*, 31*p* move in the direction D under the thrust of an actuator 33 with a motion synchronized to the motion of the drawing system 15 for accompanying the pack of extended postal objects 7*e* and preventing, thanks to the abutment provided by the abut elements 31*a*, 31*p*, the extended postal objects 7*e* from possibly bending towards the packs of standard postal objects 7*s* adjacent thereto.

Figure 2:
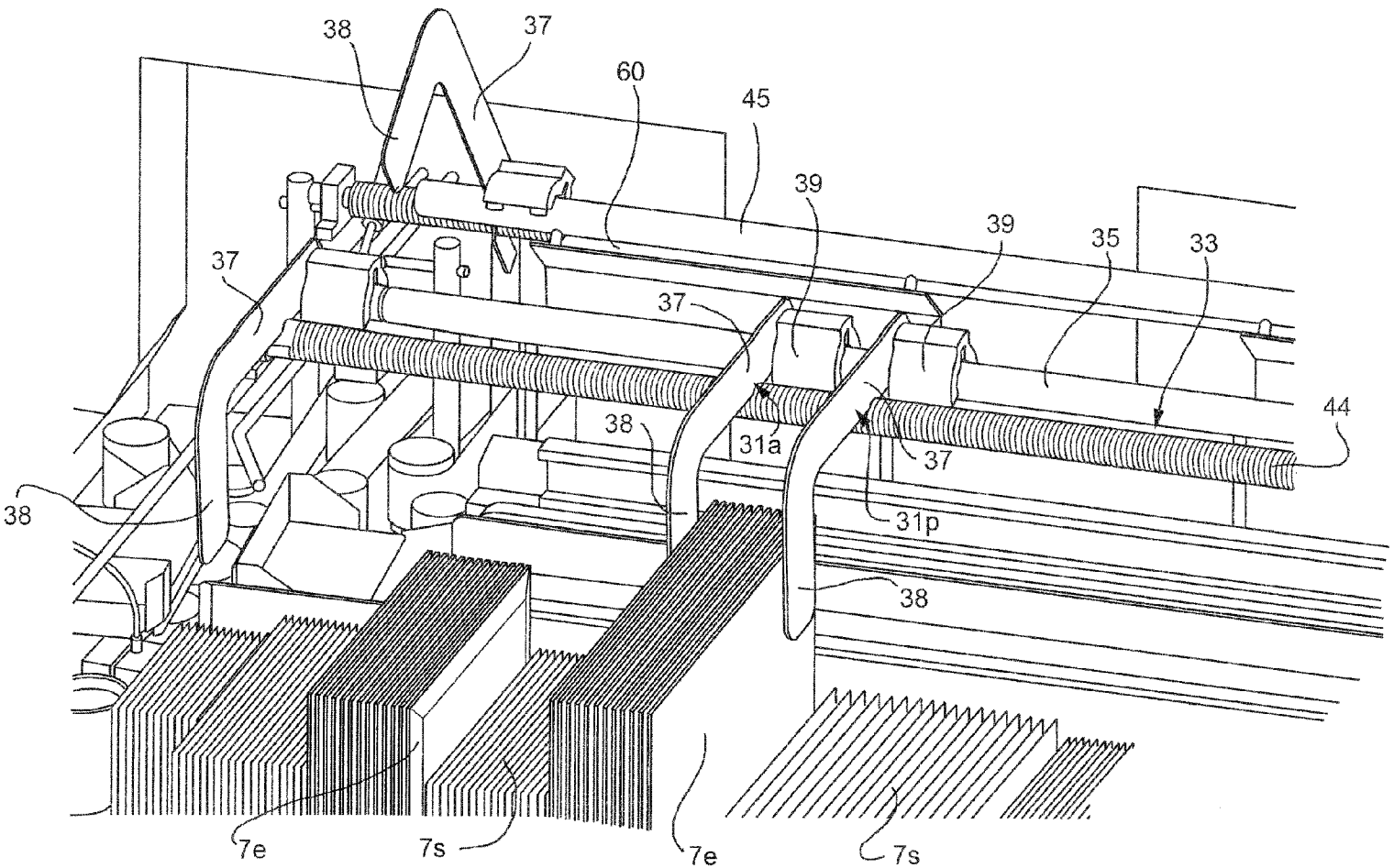
FIG. 2 illustrates, in perspective view, a detail of the device of FIG. 1.
Figure 4:
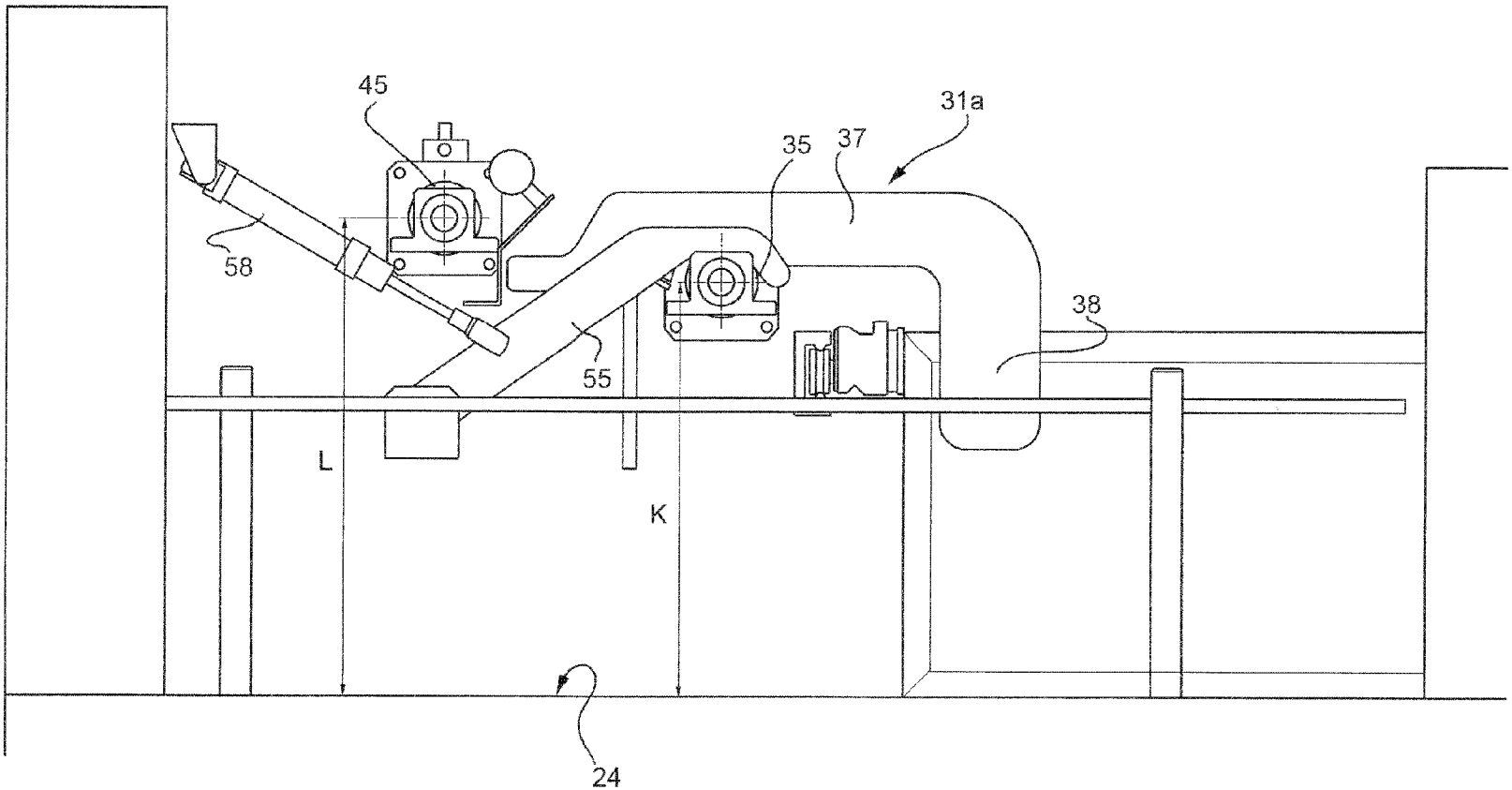
FIG. 4 is a side view of a detail of FIG. 2.
Figure 5:
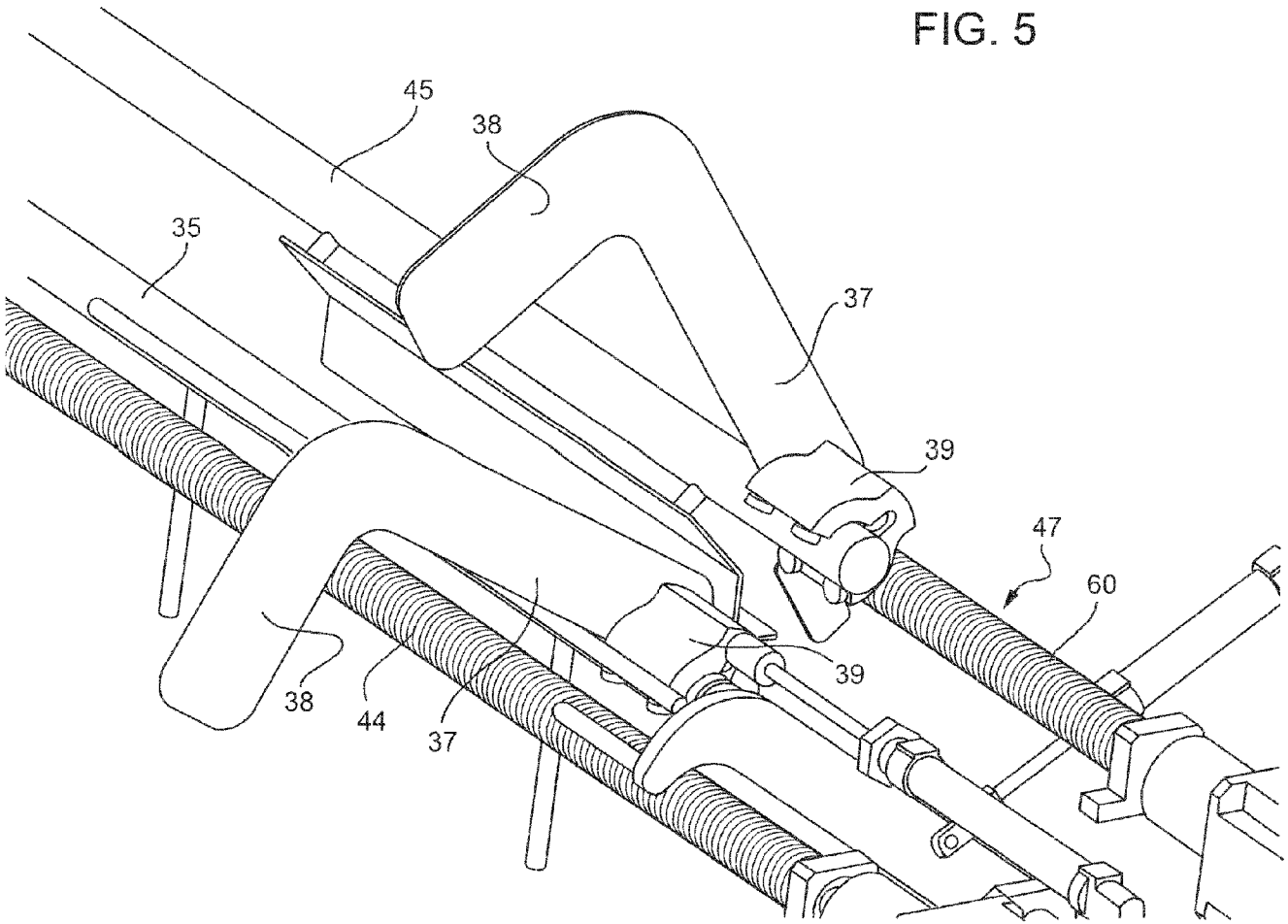
FIG. 5 illustrates, in enlarged perspective view, two elements of the device according to an embodiment of the present invention.

In particular, the abut elements 31*a*, 31*p* (see also FIG. 2) are able to slide along a guide formed by a rectilinear shaft 35 parallel to the direction D and extending throughout the length of the plate 24; in particular, the rectilinear shaft 35 has end portions carried by supporting elements (not illustrated for reasons of simplicity) that keep it anchored to the bench 22 at a constant pre-set distance K from the rectangular plate 24 (FIG. 4). Each abut element 31*a*, 31*p* comprises a plane L-shaped wall having a portion of major side 37 (FIGS. 4 and 5) connected to a tubular sleeve 39 that is able to slide along the shaft 35. In this way, an operator can regulate manually the distance (distance set) between the abut elements 31*a*, 31*p* by adjusting the mutual position of the tubular sleeves 39 along the shaft 35. Rotation of the tubular sleeve about the shaft 35 enables recession/approach of the portion of minor side 38 of the L-shaped wall from/to the pack of extended postal objects.

The actuator 33 provides a synchronous movement of the front abut element and of the rear abut element, which move at the same linear rate, keeping the set distance between them constant, moving in the direction D.

In particular, the actuator 33 comprises a wormscrew 44 with axis parallel to the direction D and angularly mobile under the thrust of an electric motor 42 (FIG. 1) provided, at output, with a motor-reducer assembly (not illustrated). The wormscrew 44 is set up against the shaft 35 at a height a little lower than the plate 24 with respect to the shaft 35 in such a way that the rectilinear portions of major side 37 of the front and rear abut elements 31*a*, 31*p* rest on and engage with the teeth of the wormscrew 44, thus maintaining a constant distance from one another during rotation of the wormscrew 44; in this way, rotation of the wormscrew 44 produces advance of the front and rear abut elements 31*a*, 31*p* along the shaft 35. The wormscrew 44 is carried by supports (not illustrated for reasons of simplicity of description) that extend from the bench 22. The electric motor 42 and the electric motor (not illustrated) that moves the slide 27 are controlled by an electronic unit (not illustrated) in such a way that the slide 27 and the front/rear abut elements 31*a*, 31*p* move synchronously at the same linear rate, for example at 10 mm/s.

The motion governed by the electronic unit (not illustrated) envisages that the slide 27 and the pusher element 29 move from a first end of the rectangular plate 24 towards a second end of the rectangular plate 24, located in the proximity of which is the singulation system 10. In this way, the packs of postal objects resting on the resting surface 12 are pushed by the pusher element 29 (blade) and by the belt 13 that cooperates in a synchronous way with the blade 29 (they are moved by the same mechanism) towards the singulation system 10 and advance in the direction of advance D. Also the front/rear abut elements 31*a*, 31*p* of each supporting unit 30 translate towards the singulation system 10 remaining in contact with the front/rear faces of the packs of extended postal objects, thus preventing opening of the packs formed by extended postal objects 7*e* during the motion of translation of the packs under the thrust of the pusher element 29.

The singulator device 1 comprises a return guide 45 parallel to the guide 35, which provides a forward guide for the front/rear abut elements 31*a*, 31*p* towards the singulator system 10. The return guide 45 is associated to a second actuator 47 that brings about a motion of recession of the front/rear abut elements 31*a*, 31*p* from the singulator system 10. The return guide is formed by a shaft, which is set parallel to the shaft 35 and has the same length and the same diameter. The shaft 45 is at a vertical distance L from the rectangular plate 24 that is greater than the distance K between the shaft 35 and the rectangular plate 24.

Provided are a first exchange device 54 configured for transferring a pair of abut elements 31*a*, 31*p* (or even a single abut element) that has arrived at a front end portion of the forward guide 35 to a corresponding front portion of the return guide 45, and a second exchange device 50 (FIG. 1) configured for transferring a pair of abut elements (or even a single abut element) that has arrived at a rear end portion of the return guide 45 to a corresponding rear portion of the forward guide 35.

In this way, when a pair of front/rear abut elements 31*a*, 31*p* reaches the front end portion of the shaft 35 facing the singulation system 10 at least one abut element 31*a*, 31*p* is transferred from the first exchange device 54 to the front portion of the return guide 45, where the second actuator 47 provides the movement of the abut element 31*a*, 31*p* towards the rear end. The second exchange device 50 enables transfer of at least one abut element 31*a*, 31*p* from the rear portion of the return guide 45 to the rear portion of the forward guide 35. There is thus performed a sort of "recirculation" of the abut elements between the two guides 34, 45.

The first exchange device 54 (FIGS. 3 and 4) comprises a lever 55 having a first end hinged to the bench 22 and a second end that carries a cylindrical appendage 57 (FIG. 3) transverse to the lever 55 and having the same diameter as the forward shaft 35 and return shaft 45. The lever 55 is mobile under the thrust of a hydraulic actuator 58 between a first angular position (FIG. 3), in which the cylindrical appendage 57 is coaxial to and set up against the front end of the forward shaft 35 and a second angular position (not illustrated), in which the cylindrical appendage 57 is coaxial to and set up against the front end of the return shaft 45.

In the first angular position, the motion of the wormscrew 44 provides the passage of a abut element 31*a*, 31*p* from the shaft 35 to the appendage 57, which is then made to turn in order to reach the second angular position. The movement of the second actuator 47 provides the motion of the abut element 31*a*, 31*p* from the appendage 57 to the return shaft 45. Repeating the aforesaid operations, pairs of abut elements are transferred.

The second exchange device 50 has a structure and operation similar to the one illustrated above and consequently will not be described.

The second actuator is also formed by a wormscrew 60 driven by an actuator 61 (FIG. 1) and set up against and parallel to the shaft 45.

When a sleeve 39 is set on the shaft 45, an end portion of major side 37 of the abut element 31*a*, 31*p* (the abut element tends to turn by gravity to carry the portion of minor side 38 downwards) engages with the teeth of the wormscrew 60. This contact sets a limit to the rotation of the abut element 31*a*, 31*p*.

The wormscrew 60 moves in a direction of rotation opposite to that of the wormscrew 40, displacing the abut element 31*a*, 31*p* towards the rear portion of the return guide 45.

The invention claimed is:

1. A singulator device for standard postal objects and extended postal objects configured for receiving at input groups of standard/extended plane rectangular postal objects grouped in packs and supplying at output singulated standard/extended postal objects, the device comprising:

a singulator system;

a resting surface for the packs of postal objects;

a drawing system that displaces the packs towards said singulator system designed to withdraw individually the postal objects that form a front end face of the pack; the postal objects forming the front face of the pack abut against a gripping portion that moves the objects in a direction transverse to that of advance, separating them from the pack;

supporting means configured for providing abutments on opposite top end portions of the packs comprising extended postal objects to keep the extended postal objects with planes thereof lying substantially perpendicular to the direction of advance and to prevent the extended postal objects from possibly bending towards the adjacent packs formed by standard postal objects, the supporting means include a plurality of supporting units each of which is designed to couple with a respective pack of the extended postal objects; and a supporting unit including a first abut element and a second abut element, the distance between which, in the direction of advance, is adjustable in order to arrange the first and second abut elements against a top portion of a front face and, respectively, a rear face of the pack of the extended postal objects, each of the first and second abut elements move under the thrust of an actuator with a motion synchronized with the motion of the drawing system for accompanying the pack of the extended postal objects and preventing, as a result of the abut provided by the first and second abut elements, the extended postal objects from possibly bending towards the packs of standard postal objects.

2. The device according to claim 1, wherein said abut elements are able to slide along a rectilinear guide parallel to the direction of advance; each abut element comprises a shaped wall, in particular an L-shaped wall, having an end portion connected to an element that is able to slide along said guide; the distance between the abut elements being settable by manually modifying the mutual position of the elements along the rectilinear guide.

3. The device according to claim 2, wherein said guide comprises a rectilinear shaft.

4. The device according to claim 2, further comprising:

a return guide that is substantially parallel to said guide which provides a forward guide for the front/rear abut elements towards the singulator system; said return guide being associated to a second actuator that provides a motion of recession of the front/rear abut elements from the singulator system;

first exchange means configured for transferring at least one abut element that has reached a front end portion of the forward guide to a corresponding front portion of the return guide; and second exchange means configured for transferring at least one abut element that has reached a rear end portion of the return guide to a corresponding rear portion of the forward guide.

5. The device according to claim 4, wherein said first exchange means comprise an angularly mobile element that carries an appendage shaped for carrying at least one abut element; it being possible for said angularly mobile element to be set either in a first angular position, in which said appendage is coaxial and set up against the front end of the forward guide, or in a second angular position, in which the appendage is coaxial and set up against the front end of the return guide; in the first position, the motion of said actuators ensure passage of a abut element from the forward guide to the appendage, which is then made to turn in order to reach the second angular position; the movement of said second actuator provides the motion of the abut element from said appendage to said return guide.

6. The device according to claim 4, wherein the second actuator comprises a motor-driven wormscrew.

7. The device according to claim 1, wherein said actuator provides a synchronous movement of the front abut element and of the rear abut element, which keep the distance set constant, moving in the direction of advance.

8. The device according to claim 1, wherein said actuator comprises a wormscrew with an axis substantially parallel to the direction of advance and angularly mobile under the thrust of an electric motor; the wormscrew being set in such a way that portions of the front and rear abut elements rest on and engage with the teeth of the wormscrew so that rotation of the wormscrew produces advance of the front and rear abut elements in said direction of advance.

9. The device according to claim 1, wherein said drawing system comprises a rectilinear guide substantially parallel to the direction of advance along which a slide moves, provided with pusher element having a plane of lie transverse to the direction of advance and transverse to the resting surface; said pusher element is designed to come to abut against a rear face of a pack that is resting on the surface in order to move a front face of the pack towards the singulation system.

10. A singulator device for standard postal objects and extended postal objects configured for receiving at input groups of standard/extended plane rectangular postal objects grouped in packs and supplying at output singulated standard/extended postal objects, the device comprising:

a singulator system;

a resting surface for the packs of postal objects;

a drawing system that displaces the packs towards said singulator system designed to withdraw individually the postal objects that form a front end face of the pack; the postal objects forming the front face of the pack abut against a gripping portion that moves the objects in a direction transverse to that of advance, separating them from the pack; and supporting means different from the drawing system, the support means configured for providing abutments only on opposite top end portions of the packs comprising extended postal objects, to keep the extended postal objects with planes thereof lying substantially perpendicular to the direction of advance and prevent the extended postal objects from bending towards the adjacent packs formed by standard postal objects.

* * * * *